United States Patent [19]

Lindstrom

[11] Patent Number: 4,909,333

[45] Date of Patent: Mar. 20, 1990

[54] VIBRATORY PLOW

[75] Inventor: Edgar K. Lindstrom, Wichita, Kans.

[73] Assignee: J. I. Case Company, Racine, Wis.

[21] Appl. No.: 216,584

[22] Filed: Jul. 7, 1988

Related U.S. Application Data

[63] Continuation-in-part of Ser. No. 155,398, Feb. 12, 1988.

[51] Int. Cl.[4] ..... A01B 35/00

[52] U.S. Cl. ..... 172/40; 405/182

[58] Field of Search ..... 405/174, 180–183; 172/40, 699

[56] References Cited

U.S. PATENT DOCUMENTS

| | | | |
|---|---|---|---|
| 3,838,740 | 10/1974 | Rogers et al. | 172/40 X |
| 4,103,501 | 8/1978 | Laurent | 172/40 X |
| 4,119,157 | 10/1978 | Schuck et al. | 405/182 X |
| 4,164,982 | 8/1979 | Draney | 172/40 |
| 4,229,044 | 10/1980 | Cobb et al. | 172/40 X |
| 4,240,509 | 12/1980 | Hansen | 172/699 X |
| 4,252,376 | 2/1981 | Gurries | 172/40 X |
| 4,260,290 | 4/1981 | Flippin | 405/181 |

*Primary Examiner*—David H. Corbin

*Attorney, Agent, or Firm*—Dykema Gossett

[57] ABSTRACT

A vibratory plow assembly which provides improved vibratory plowing through the mounting of the plow blade and maneuverability of the assembly. The assembly includes a forward frame member, a rearward frame member, and spaced apart link members pivotally connecting the frame members to permit relative vertical movement. A plow blade and gage wheel holder is pivotally mounted to the rearward frame member which also includes a vibrator for the plow blade. The forward frame member is pivotally mounted to a vehicle for movement about a vertical axis, and the plow blade holder is pivotally mounted to the rearward frame member for movement about a vertical axis. Further, the assembly is constructed such that the plow blade moves into a tucked relationship with respect to the connecting links between the frame members, thereby permitting loading and unloading of the plow assembly without the need to remove the plow blade. The disclosed vibratory plow assembly utilizes a combination of boom steering and blade steering for moving the plow blade laterally relative to the center line of the vehicle to permit offset plowing next to buildings and the like. Moreover, the blade holder provides improved and efficient mounting of the plow blade, and the gage wheel construction assists in the maintenance of constant blade and cable burial depth regardless of the contour of the ground surface.

8 Claims, 4 Drawing Sheets

VIBRATORY PLOW

This is a continuation-in-part application of my earlier copending application Ser. No. 155,398, filed Feb. 12, 1988.

BACKGROUND OF THE INVENTION

The present invention relates generally to a vibratory plow which is adapted to lay cable, flexible pipe, and the like underground in the cut made by a blade wherein the blade is vibrated to reduce the force required to pull the blade through the ground. More particularly, the present invention relates to a vibratory plow assembly which provides for improved vibratory plowing.

Vibratory cable plows have been used for several years to lay cable, flexible pipe, and the like underground. The cable or pipe may be either pulled through the cut of the plow blade or a cable chute may be provided on the trailing edge of the plow blade which guides the cable or pipe into the ground from a drum mounted on the tractor or other vehicle. Various types of vibrators have been mounted on the plow blade, or the vibrator and blade have been suspended together on a resilient frame assembly to generate either vertical or orbital motion in the plow blade. Examples of such prior art vibratory plows are disclosed in U.S. Pat. Nos. 4,040,261, 3,618,237 and 3,363,423, all assigned to the assignee of the present invention.

A preferred frame assembly of prior art vibratory plows, as shown in the above-referenced patents, includes two pairs of parallel side links which are resiliently supported by torsional bearing connections to forward and rearward frame members comprising generally vertical stanchions or columns. The plow blade and vibrator are supported by the rearward frame member. The vibrator generates substantially vertical vibrations in the plow blade when the vehicle is stationary and orbital vibration in the blade as the blade is pulled through the ground.

The torsional bearing connections between the side links and frame members provide resiliency for the plow blade assembly, however, because of their stiffness, the entire plow assembly is not easily raised for transport. Further, since cable plow assemblies are large and heavy apparatus, it is very difficult to provide a lift arrangement that operates simply for raising the plow frame adequately for transport. For example, it is desirable to have a high angle of blade departure when loading a vibratory plow for transporting it to different locations such that the plow can be loaded and unloaded using a standard truck loading ramp without removing the blade. It is also desirable that the overall length of the prime mover and the plow assembly be relatively short to minimize the space taken on the trailer or truck bed. However, known vibratory plow frame geometry limits the angle of blade departure and forces the blade rearwardly as the plow is raised for transport. Thus, there has been a need for a lift mechanism that provides a high angle of departure and prevents rearward movement of the plow blade so that the vibratory plow assembly can be loaded onto a trailer without removing the blade.

In prior vibratory plow constructions of the type described above, the plow blades are also heavy and difficult to mount. Typically, the mounting of a vibratory plow blade requires precisely aligning the mounting holes in the long, heavy blade with corresponding holes in a blade holder and then driving pins into place through the mounting holes. This is a very difficult procedure to perform, particularly if there is a need in the field to repair or replace the plow blade. Thus, there has been a need for a vibratory plow construction which simplifies the mounting of the heavy plow blade.

Vibratory plows have also been provided with gage wheels to provide support to the vibrator and plow blade as well as flexing against the substantial vertical shaking. An example of such a construction is shown in U.S. Pat. No. 3,390,533. If, however, the plow blade either follows or precedes the gage wheels, as shown in the just-mentioned prior art patent, the blade and cable burial depth will not remain constant. Thus, there has been a need for a vibratory plow construction which locates the plow blade below the area where the gage wheels contact the ground so that any upward or downward movement of the gage wheels because of uneven ground will be directly transmitted to the blade, thereby maintaining the plow blade and cable burial depth constant regardless of the contour of the ground surface.

Maneuverability of the cable plow assembly is also desirable since it is common for the plowing to take place next to buildings, fences, obstructions, or along roadsides. For regular plowing in normal conditions, the vibratory plow boom is positioned such that the plow will follow the prime mover. However, when plowing next to buildings and the like, the plow blade must be moved laterally relative to the prime mover. Thus, there continues to be a need for a vibratory plow arrangement that provides for maximum maneuverability and easy operation for offset plowing.

It has now been discovered that a vibratory plow assembly constructed in accordance with the teachings of the present invention provides improved vibratory plowing and avoids the disadvantages and limitations of the prior constructions, as hereinabove described.

SUMMARY OF THE INVENTION

As described, the vibratory plow assembly of this invention is adapted to lay an elongated element such as a cable or flexible pipe underground in the cut made by the plow blade. The assembly includes a resilient plow frame for mounting the plow on a ground-traversing vehicle, such as tractor, bulldozer, or the like. The preferred frame assembly includes a forward frame member, laterally spaced side frame members, and a rearward frame member which supports the elongated cable plow and the vibrator. The side frame members preferably comprise a pair of generally vertically spaced elongated links which converge in spaced relation toward each other. The forward and rearward ends of each link are pivotally connected to the forward and rearward frame members without using conventional torsional bearing connections.

The vibratory plow blade is mounted to a plow blade and gage wheel holder. The holder is pivotally mounted to the vibratory frame to permit rotational movement by the holder and blade about a vertical axis when the plow assembly is moved to an outboard or lateral position for offset trenching. The holder also includes hollow axle shafts for mounting gage wheels and spaced apart hanger arms for advantageously assisting in the mounting of the blade.

The plow blade is mounted between the hanger arms such that its upper mounting hole is supported by an upper mounting pin between opposed slots in the hanger arms. Further, the lower mounting hole in the plow blade is supported by a lower mounting pin between the opposed hollow axle shafts. This construction substantially improves the ease in mounting the heavy plow blade and also optimally locates the blade relative to the gage wheels.

When it is desired to mount the plow blade to the holder, the upper blade mounting pin is inserted in the upper plow blade hole, and then the blade is positioned between the hanger arms such that the opposed ends of the mounting pin fit within the opposed slots in the hanger arms, thereby permitting the blade to hang downwardly. With the plow blade and upper mounting pin in place between the hanger arms, the blade may then be maneuvered so that the lower mounting pin may be inserted through the opposed hollow axle shafts and through the lower blade mounting hole.

The present construction provides for substantially improved mounting of the heavy vibratory plow blade as compared to the prior art where mounting holes in a blade had to be aligned with holes in the blade holder, and then mounting pins were driven into place. Moreover, since the gage wheels in the present construction are mounted to the holder on the same center line or axis as the lower mounting pin for the plow blade, the optimal location for the gage wheels is provided such that any upward or downward movement of the gage wheels because of uneven ground will be directly transmitted to the plow blade.

The vibratory plow assembly of the present invention is also constructed to provide a high angle of departure for the plow blade so that the plow can be loaded and unloaded using a standard truck loading ramp without removing the plow blade. The rearward frame member, which supports the elongated cable plow and the vibrator, is of a shorter length than the forward frame member. Further, in the disclosed embodiment, the upper side frame member is longer than the lower side frame member. As the plow assembly is raised for transport, the present construction causes the plow blade to rotate into a substantially parallel relationship with the lower side frame member. This results in a tucked position for the plow blade that permits transportation of the plow assembly without removing the blade.

The improved maneuverability of the present plow assembly is provided by lift control, boom swing, and blade steering apparatus. The lift control sets the plow height position and provides downward pressure which is used to force the blade into the ground in more difficult plowing conditions. In normal plowing, the lift control is in "float," thereby allowing the plow blade to follow the contour of the ground to ensure proper burial depth. A hydraulic boom swing positions the plow blade laterally from the longitudinal axis of the prime mover. This permits movement of the plow blade to a position for offset plowing next to buildings, fences, and the like. The blade steering apparatus allows the operator to independently move the blade several degrees to the left or right of center. During offset plowing, the operator uses the combined maneuverability provided by the blade steering and boom steering.

Other advantages and meritorious features of the present invention will be more fully understood from the following description of the invention, the appended claims and the drawings, a brief description of which follows.

DETAILED DESCRIPTION OF THE INVENTION

Figure 1:
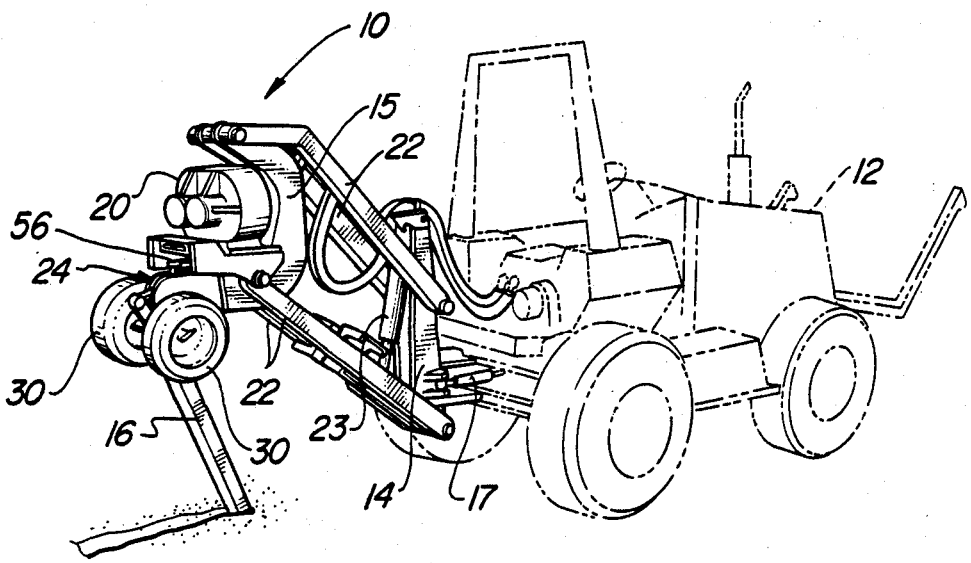
FIG. 1 is a side perspective view of a tractor and vibratory cable laying plow made in accordance with the teachings of the present invention.

Referring to FIG. 1, a vibratory plow assembly 10 made in accordance with the teachings of the present invention is connected to the rear of vehicle 12, which may be a tractor, bulldozer, or the like. Generally, the vibratory plow assembly 10 includes a vertical mast or boom assembly 14 which is attached to the rear of vehicle 12, a vertical shaker frame 15, and a plow blade 16. Blade 16 may include a cable guide (not shown) supported thereon for receiving a cable which is continuously fed into and along the bottom of the ground slot formed by blade 16, as is conventional. Boom assembly 14 is conventionally mounted to the rear of vehicle 12 by a pin (not shown) for permitting pivotal movement of boom 14 about a vertical pivot axis. Hydraulic swing cylinders 17 are connected between tractor 12 and boom 14 for swinging shaker frame 15 laterally from the longitudinal axis of tractor 12.

Shaker frame 15 has a power-driven oscillating mechanism 20 supported thereon for reciprocating blade 16 vertically between upper and lower limits. Shaker frame 15, oscillating mechanism 20, and blade 16 are suspended from mast assembly 14 by upper and lower pairs of connecting links 22. As is conventional, the oscillating mechanism 20 is adapted to vibrate blade 16 and thereby transmit an arcuate or orbital motion to the blade. A hydraulic lift cylinder 23 is connected between boom 14 and the lower pair of links 22 for raising and lowering blade 16 to various height positions. Cylinder 23 may be extended for forcing blade 16 into the ground in more difficult plowing conditions. In normal plowing, cylinder 23 is placed in a conventional "float" position, thereby allowing the plow blade 16 to follow the contour of the ground to ensure proper burial depth.

Figure 2:
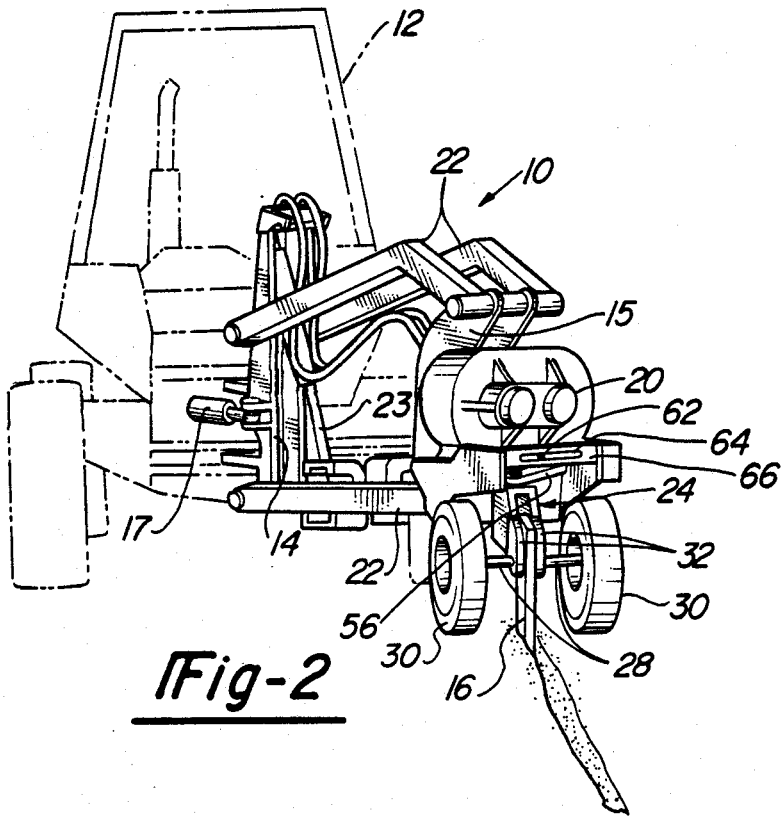
FIG. 2 is a rear view of the vibratory plow assembly shown in FIG. 1.
Figure 6:
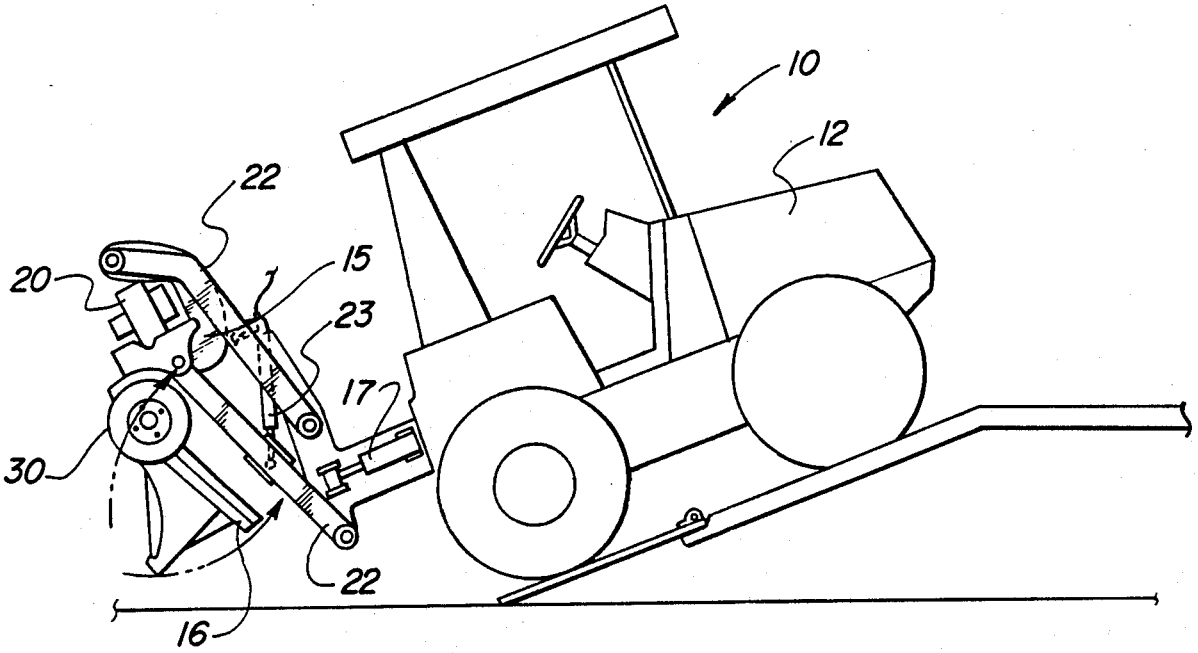
FIG. 6 is a side view of the tractor and vibratory cable laying plow in the transport position.

As shown in FIGS. 1, 2 and 6, the rear frame 15 is of a shorter length than the forward mast or boom 14. Further, the lower pair of connecting links 22 are of a shorter length than the upper pair of connecting links 22. Moreover, the lower connecting links 22 are straight whereas the upper connecting links are bent at an obtuse angle, and the connections between links 22 and frames 14 and 15 are non-torsional bearing connections. Thus, when plow assembly 10 is raised to its transport position as shown in FIG. 6, the plow blade 16 is brought into a generally parallel relationship with lower links 22, and this tucked position permits loading of the plow assembly 10 without removing plow blade 16.

Referring now to FIGS. 2–4 and 5, the plow blade assembly 10 and associated structure of the present invention is shown in further detail. Plow blade 16 is mounted to a plow blade and gage wheel holder 24. Holder 24 is pivotally mounted to shaker frame 15 by pin 26 to permit rotational movement by holder 24 and blade 16 about a vertical axis formed by pin 26 when the plow assembly 10 is moved to an outboard or lateral position for offset plowing, such as shown in FIG. 2. Holder 24 also includes hollow axle shafts or bearing members 28 for mounting gage wheels 30 and spaced apart hanger arms 32 for advantageously assisting in the mounting of plow blade 16, as will now be described.

Blade 16 is mounted between hanger arms 32 such that its upper mounting hole 34 is supported by pin 36 between opposed slots 38, and its lower mounting hole 40 is supported by pin 42 between opposed hollow axle shafts 28. This construction substantially improves the mounting of the heavy elongated plow blade 16 and optimally locates blade 16 relative to gage wheels 30.

When it is desired to mount blade 16 on holder 24, the upper blade mounting pin 36 is inserted in the upper plow blade hole 34, and then blade 16 is positioned between hanger arms 32 such that the opposed ends of pin 36 fit within the opposed slots 38, thereby permitting blade 16 to hang downwardly. With plow blade 16 and upper mounting pin 36 in place in holder 24, blade 16 can be maneuvered easily so that the lower mounting pin 42 may be inserted through the opposed axle shafts 28 and the lower blade mounting hole 40. The openings through axle shafts 28 are larger than the mounting holes in the hanger arms 32 for ease of assembly.

The above-described construction provides for considerable ease in mounting plow blade 16 as compared to the prior art requirement for precisely aligning holes in a blade with holes in a holder and then driving mounting pins into place. Moreover, since the gage wheels 30 are mounted to holder 24 on the same center line or axis as lower mounting pin 42, the optimal location for the gage wheels 30 is provided. A substantial length of the plow blade 16 is directly below the area where the gage wheels 30 contact the ground, and therefore, any upward or downward movement of the gage wheels 30 because of uneven ground will be directly transmitted to the plow blade 16. This permits the maintenance of constant blade and cable burial depth regardless of the counter of the ground surface.

Figure 3:
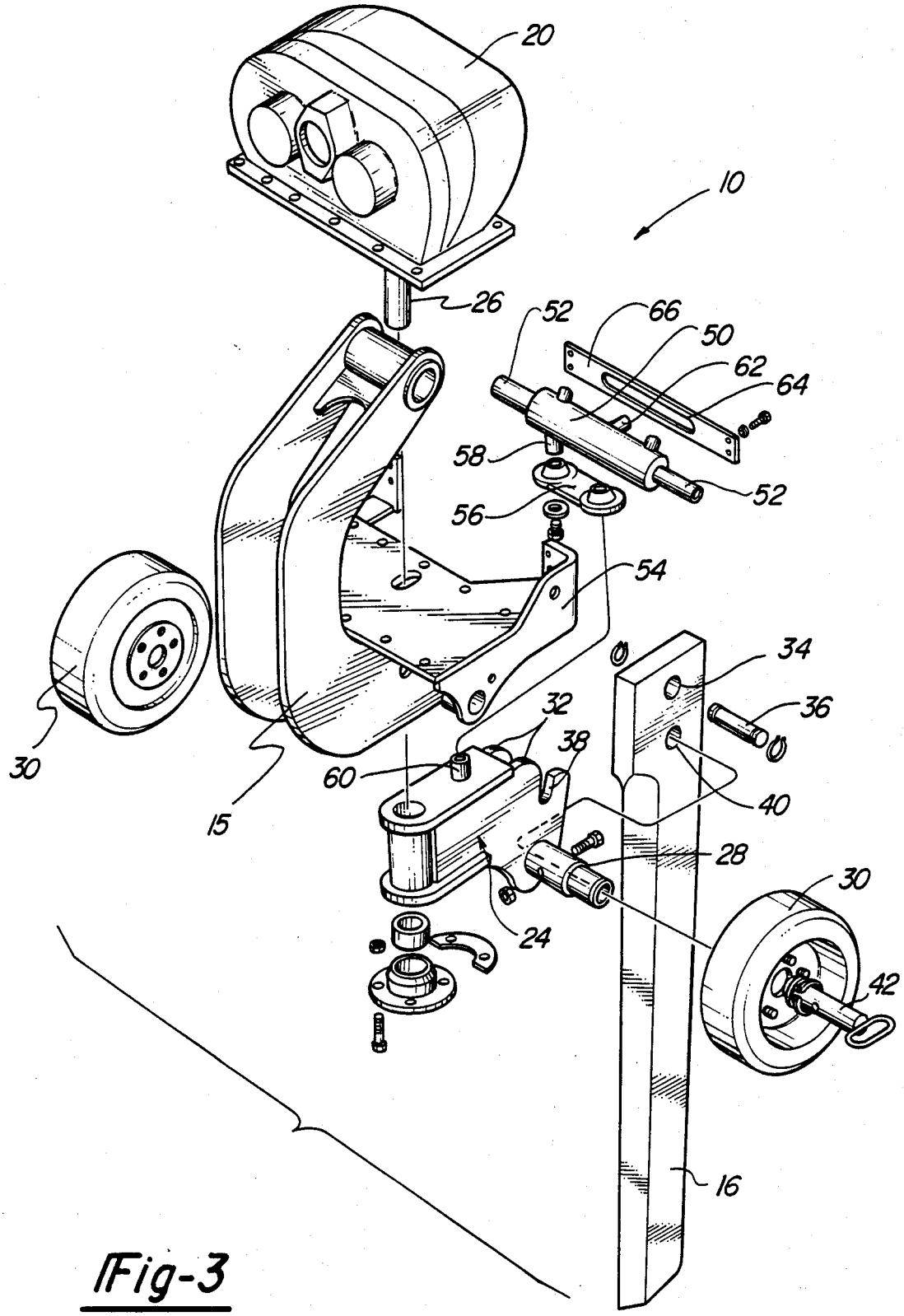
FIG. 3 is an assembly drawing of the plow blade, plow blade holder, and associated structure of the present invention.
Figure 4:
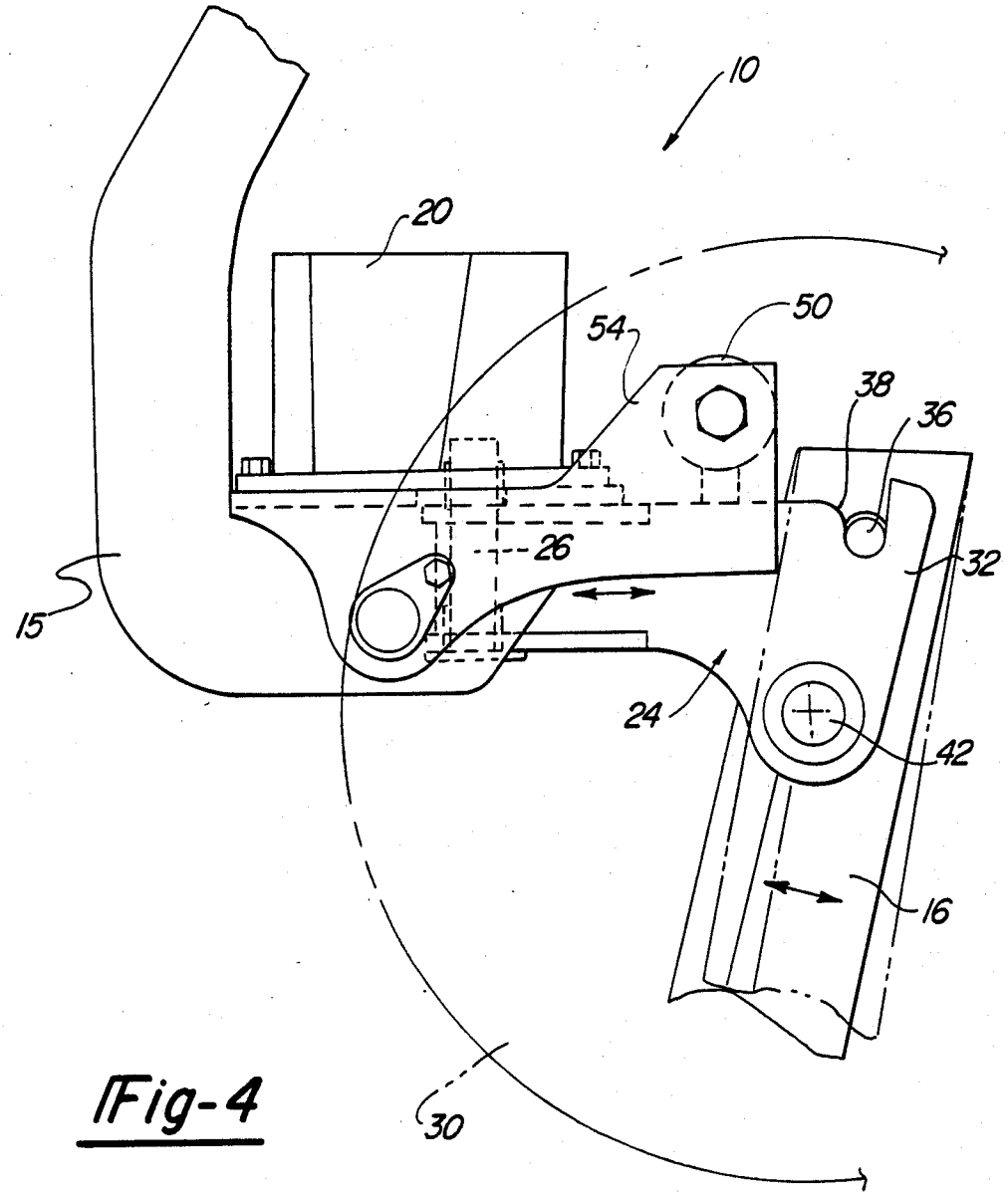
FIG. 4 is a partial side elevational view of the plow blade and plow blade holder.
Figure 5:
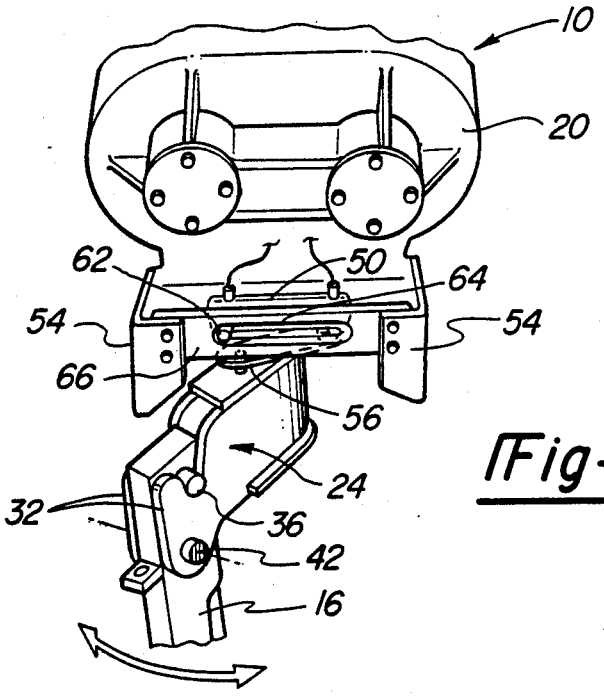
FIG. 5 is a partial rear view illustrating the blade steering apparatus.

Referring now to FIGS. 3 and 5, the blade steering apparatus includes a double-acting hydraulic cylinder 50 which has its piston rod 52 mounted between upstanding portions 54 of shaker frame 15. Cylinder 50 is connected to holder 24 by means of link 56. One end of link 56 is pivotally connected to cylinder 50 by pin 58 while the opposite end of link 56 is pivotally connected to holder 24 by pin 60. Cylinder 50 includes a pin 62 that is slidable within a slot 64 in cover plate 66. Thus, as will be apparent to those skilled in the art, the linear movement of cylinder 15 along its piston rod 52 will result in the rotational movement of holder 24 and plow blade 16 about vertical pin connection 26.

In operation, the hydraulic lift cylinder 23 controls the height position of plow blade 16. Cylinder 23 exerts a downward pressure for forcing the blade into the ground in more difficult plowing conditions. Normally, the lift cylinder 23 is in a "float" position, thereby allowing the plow to follow the contour of the ground. When it is desired to perform offset plowing, the hydraulic boom swing cylinders 17 are actuated for rotating the plow assembly 10 laterally relative to the center line of fractor 12. Moreover, plow blade 16 may be steered by actuating hydraulic cylinder 15 which causes blade 16 to rotate several degrees to the left or right of center. Thus, the operator utilizes the combination of lift control, boom steering, and blade steering to provide maneuverability to the plow blade for offset plowing next to buildings, fences, obstructions, and the like.

It will be understood that the foregoing disclosure is exemplary in nature and that various modifications may be made to this invention without departing from the appended claims.

I claim:

1. A vibratory plow assembly comprising:

a forward frame member pivotally attached to a vehicle for movement about a first vertical axis, and means for rotating said forward frame member about said first vertical axis;

a rearward frame member spaced from said forward frame member, said rearward frame member being of a shorter length than said forward frame member, and a vibrator mounted on said rearward frame member;

a plow blade pivotally mounted to said rearward frame member for movement about a second vertical axis and said vibrator operatively connected to said plow blade to vibrate said plow blade;

upper and lower link means pivotally connected between said forward and rearward frame members, and a lift cylinder connected between said forward frame member and one of said link means for raising and lowering said rearward frame member relative to said forward frame member; and said plow blade being movable into a generally parallel relationship with respect to said lower link means when said rearward frame member is raised relative to said forward frame member;

wherein said lower link means is of a shorter length than said upper link means; and wherein the pivotal connections between said link means and said frame members are non-torsional bearing connections; and wherein a blade holder is pivotally mounted to said rearward frame member and means connected between said rearward frame member and said blade holder for rotating said blade holder and plow blade about said second vertical axis relative to said rearward frame member.

2. The vibratory plow assembly as defined in claim 1 wherein said lower link means is linear and said upper link means is bent at an obtuse angle along its length.

3. The vibratory plow assembly as defined in claim 1 wherein said means for rotating includes a movable cylinder mounted on said rearward frame member and means connecting said movable cylinder to said blade holder such that linear movement of said cylinder is translated into rotational movement of said blade holder.

4. A vibratory plow assembly comprising:

a forward frame member pivotally connected to a vehicle for movement about a first vertical axis;

a rearward frame member spaced from said forward frame member, a blade holder pivotally mounted to said rearward frame member for movement about a second vertical axis relative to said rearward frame member, and a vibrator mounted on said rearward frame member;

a plow blade including an upper mounting opening and a first pin means extending therethrough, said blade holder includes opposed hanger arms having slots therein for supporting opposite ends of said first pin means, said blade positioned between said hanger arms such that the opposite ends of the first pin means fit within the slots, and said vibrator operatively connected to said plow blade to vibrate said plow blade; and upper and lower link means pivotally connected between said forward and rearward frame members, and lift means connected between said forward frame member and one of said link means for raising and lowering said rearward frame member relative to said forward frame member; and means connected between said rearward frame member and said blade holder for rotating said blade holder about said second vertical axis relative to said rearward frame member.

5. The vibratory plow assembly as defined in claim 4 wherein the plow blade having a lower mounting opening, a second pin means extending therethrough having a longitudinal axis, means for mounting gage wheels to said gage holder and said mounting means having a longitudinal axis, and said second pin means extending through said mounting means such that the longitudinal axis of said second pin means is substantially coincident with the longitudinal axis of said mounting means.

6. The vibratory plow assembly as defined in claim 5 wherein the mounting means comprises opposed hollow bearing members with said second pin means extending through said hollow bearing members.

7. The vibratory plow assembly as defined in claim 4 wherein said rearward frame member is a shorter length than said forward frame member, said lower link means is a shorter length than said upper link means, and said lower link means being linear whereas said upper link means being bent at an obtuse angle along its length.

8. The vibratory plow assembly as defined in claim 4 wherein said means for rotating said blade holder include a linearly movable cylinder mounted on said rearward frame member which is pivotally connected to said blade holder such that the linear movement of said cylinder is translated into rotational movement of said blade holder.

* * * * *